United States Patent [19]

Lindmayer

[11] Patent Number: 4,748,375

[45] Date of Patent: May 31, 1988

[54] STABLE OPTICALLY TRANSMISSIVE CONDUCTORS, INCLUDING ELECTRODES FOR ELECTROLUMINESCENT DEVICES, AND METHODS FOR MAKING

[75] Inventor: Joseph Lindmayer, Rockville, Md.

[73] Assignee: Quantex Corporation, Rockville, Md.

[21] Appl. No.: 813,929

[22] Filed: Dec. 27, 1985

[51] Int. Cl.[4] ..... H05B 33/22; H05B 33/24

[52] U.S. Cl. ..... 313/509; 313/506

[58] Field of Search ..... 313/506, 509, 498, 503

[56] References Cited

U.S. PATENT DOCUMENTS

| | | | |
|---|---|---|---|
| 3,522,071 | 7/1970 | Yokota et al. | 427/64 |
| 3,927,224 | 12/1975 | Levene | 427/64 |
| 4,201,798 | 5/1980 | Lindmayer | 427/74 |
| 4,263,339 | 4/1981 | Fischer | 427/64 |
| 4,416,933 | 11/1983 | Antson et al. | 313/509 X |
| 4,418,118 | 11/1983 | Lindors | 313/509 X |

OTHER PUBLICATIONS

*Flat-Panel Displays and CRT's*, Tannas, Jr. (ed.), pp. 237–288, Van Nostrand Reinhold, 1985.

*Primary Examiner*—David K. Moore
*Assistant Examiner*—K. Wieder
*Attorney, Agent, or Firm*—Peter C. Van Der Sluys

[57] ABSTRACT

Disclosed are optically transmissive conductors, particularly resistive electrodes for optical devices such as electroluminescent lamps and displays, comprising a thin layer of indium tin oxide (ITO) stabilized by a layer of a metal oxide, such as palladium oxide or nickel oxide. In the disclosed method, a thin layer of conductive ITO is coated with a metal layer and then oxidized by heating in air to 500° C.

9 Claims, 1 Drawing Sheet

STABLE OPTICALLY TRANSMISSIVE CONDUCTORS, INCLUDING ELECTRODES FOR ELECTROLUMINESCENT DEVICES, AND METHODS FOR MAKING

BACKGROUND OF THE INVENTION

The present invention relates generally to optically transmissive conductors and, more particularly, to optically-transmissive electrodes for electroluminescent devices. In the context of electroluminescent devices, this is a companion to related application Ser. No. 813,928, filed Dec. 27, 1985, concurrently herewith, by Joseph Lindmayer, and entitled "Dielectric for Electroluminescent Devices, and Methods for Making", issued Sept. 15, 1987 as U.S. Pat. No. 4,693,906 the entire disclosure of which is hereby expressly incorporated by reference. The subject invention and the invention to which related application Ser. No. 813,928 is directed are each improvements in the field of electroluminescent devices and, when employed together, result in highly-reliable and bright electroluminescent devices which operate without catastrophic breakdowns.

Electroluminescent devices have a long history, both as lamps and as displays. Earlier development had as its objective the development of a solid state lamp as a light source, typically in the form of a flat panel. More recently, electroluminescence has been employed in flat panel display systems, involving either pre-defined character shapes or individually-addressable pixels in a rectangular matrix.

The basic structure of an electroluminescent device is well known, and comprises an electroluminescent layer sandwiched between a pair of electrodes and separated from the electrodes by respective dielectric layers. Electroluminescence is the emission of light from a polycyrstaline phosphor solely due to the application of an electric field. While various electroluminescent materials are known, one generally accepted is ZnS as a host, with Mn as an activator.

For separating and electrically insulating the electroluminescent layer from the electrodes, a variety of dielectric materials have been proposed and employed, a subject to which the above-identified companion application Ser. No. 813,928 is directed.

The electrodes differ from each other, depending upon whether it is the "rear" or the "front" (viewing) side of the device. A reflective metal, such as aluminum, is typically employed for the electrode on the "rear" side of the device, and a relatively thin optically transmissive layer of indium tin oxide (ITO) is typically employed for the electrode on the "front" side of the device. In lamp applications, both electrodes take the form of continuous layers, thereby subjecting the entire electroluminescent layer between the electrodes to the electric field. In a typical display application, the "front" and "rear" electrodes are suitably patterned so as to define row and column electrodes. Pixels are thus defined where the row and column electrodes overlap. Various electronic display drivers are well known which address individual pixels by energizing one row electrode and one column electrode at a time.

While seemingly simple in concept, the development of electroluminescent devices has met with many practical difficulties. Very generally, these practical difficulties arise from two factors. First, the devices are thin-film devices where even a small defect in a particular layer can cause a failure. Second, these thin-film devices are operated at relatively high voltages, typically ranging from 100 volts to 400 volts peak-to-peak. In this regard, electroluminescent devices are perhaps unique among solid state electronic devices in that the ZnS electroluminescent layer is operated beyond its dielectric breakdown voltage, and thus conducts, while the thin-film dielectric layers on either side are required to stop the conduction.

Manifestly, even a small defect can lead to catastrophic failure, and this has indeed been a problem with the prolonged application of large electric fields, accompanied by high temperatures during operation.

The present invention is particularly directed to the "front" optically-transmissive electrode, which typically comprises a layer of indium tin oxide (ITO) approximately 200 nanometers ($200\times10^{-9}$ meters) in thickness deposited directly on a glass substrate. After the ITO layer is deposited, the glass substrate and the ITO layer are heated to approximately 500° C., which causes the ITO to become electrically conductive. Electrically-conductive ITO-coated glasses are commercially available as a stock material.

ITO layers having resistivities of from 20 to 1000 ohms per square are typical. It is known that an electrode layer of greater resistivity, for example in the range of 4000 to 6000 ohms per square, is advantageous in that the higher resistance mitigates the effects of a localized incipient failure in the dielectric layers by limiting the current which can flow. Thus, a resistive electrode can limit the propagation of a failure, the propagation of a failure typically being manifested by local melting of the dielectric and electrodes. With a relatively higher resistivity electrode layer, the device can continue to operate with minor failures in the dielectric which otherwise would result in catastrophic breakdown and device failure.

However, to achieve such high resistivity with indium tin oxide requires an ultra-thin layer, less than 100 angstroms ($100\times10^{-10}$ meters) thick. This, then, introduces other drawbacks. In particular, such an ultra-thin ITO layer is unable to reliably carry the lamp currents involved in operation of the device. Such a thin ITO layer has a tendency to strongly change its conductivity, and/or disconnect and burn up.

SUMMARY OF THE INVENTION

It is an object of the invention to provide a stable, resistive, optically-transmissive electrode devices such as electroluminescent lamps or displays.

It is another object of the invention to provide electroluminescent devices with improved brightness and reliability facilitated by sustained high operating voltages made possible by a stable, resistive optically-transmissive electrode.

It is another object of the invention to provide a stable optically transmissive conductor in general, having uses other than in electroluminescent devices.

Briefly, in accordance with the invention an electrically-conductive indium tin oxide layer is electrically stabilized by a layer of a metal oxide, such as palladium oxide or nickel oxide.

In accordance with the invention, an ultra-thin ITO layer is coated with a layer of, for example, palladium less than 100 angstroms in thickness, and preferably 30 to 50 angstroms in thickness. The refractory metal layer is then oxidized in air at approximately 500° C. The conductivity of the resulting double layer of ITO and palladium oxide is reduced somewhat compared to ITO alone, but the double layer is highly stable and does not change or burn out while carrying the currents associated with electroluminescent device operation. The metal oxide thus stabilizes or "passivates" the ITO layer.

It will be appreciated that optically-transmissive conductors are employed in a variety of other applications, and the invention is accordingly not limited to electroluminescent devices.

In accordance with a more particular aspect of the invention, an electroluminescent device, either a lamp or a display, comprises an electroluminescent layer sandwiched between a pair of electrodes and separated from the electrodes by respective dielectric layers. At least one of the electrodes is optically transmissive and comprises a layer of indium tin oxide on an optically transmissive substrate, such as a glass substrate. A stabilizing layer is provided over the layer of indium tin oxide, the stabilizing layer comprising a metal oxide. Preferably, the thickness of the metal is less than 100 angstroms prior to oxidation, with the preferred range being from 30 to 50 angstroms. The presently preferred stabilizing layer is palladium oxide, but other metal oxides, such as nickel oxide, may also be employed.

In accordance with another, more particular, aspect of the invention, there is provided an optically-transmissive conductor structure supported on an optically transmissive substrate. The structure comprises a layer of indium tin oxide on the optically transmissive substrate, and a stabilizing layer of a refractory metal oxide over the layer of indium tin oxide. Again, the stabilizing layer is formed of an oxidized layer of a metal having a thickness less than 100 angstroms prior to oxidation, and preferably within the range of from 30 to 50 angstroms. The stabilizing layer preferably comprises palladium oxide, but other metal oxides, such as nickel oxide, may also be employed.

A method in accordance with the invention of making an optically transmissive electrode structure for an electroluminescent device has as an initial step that of providing an optically transmissive substrate having an optically transmissive electrically conductive layer of indium tin oxide formed thereon. The indium tin oxide layer is coated with a metal layer less than 100 angstroms in thickness, and the metal layer is then oxidized. The step of oxidizing can be carried out by heating to approximately 500° C. in an atmosphere including oxygen, such as in air.

The step of coating the indium tin oxide layer with a metal layer can comprise coating with a layer of palladium less than 100 angstroms in thickness, or coating with a layer of nickel less than 100 angstroms in thickness. Preferably, the coating of the metal layer, be it palladium, nickel, or another metal, is carried out to a thickness within the preferred range of from 30 to 50 angstroms.

The step of providing an optically transmissive substrate having an optically transmissive electrically conductive layer of indium tin oxide may comprise providing a substrate having an indium tin oxide layer less than 100 angstroms in thickness formed thereon.

The invention also provides a method of making an optically transmissive conductor structure for general use, the method comprising the steps of providing an optically transmissive substrate having an optically transmissive electrically conductive layer of indium tin oxide formed thereon, which, in accordance with one aspect of the invention, is an ultra-thin layer less than 100 angstroms in thickness and thus of relatively high resistivity.

The method further comprises the steps of coating the indium tin oxide layer with a metal layer less than 100 angstroms in thickness, and then oxidizing the metal layer. The metal layer may comprise palladium or nickel, and the oxidation may be carried out by heating to approximately 500° C. in an atmosphere including oxygen, such as in air.

BRIEF DESCRIPTION OF THE DRAWING

While the novel features of the invention are set forth with particularity in the appended claims, the invention, both as organization and content, will be better understood and appreciated, along with other objects and features thereof, from the following detailed description taken in conjunction with the drawing, in which:

The single drawing FIGURE is a representative cross section of a thin film electroluminescent device, typical of either a lamp or a single pixel in a display.

DETAILED DESCRIPTION

Figure 1:
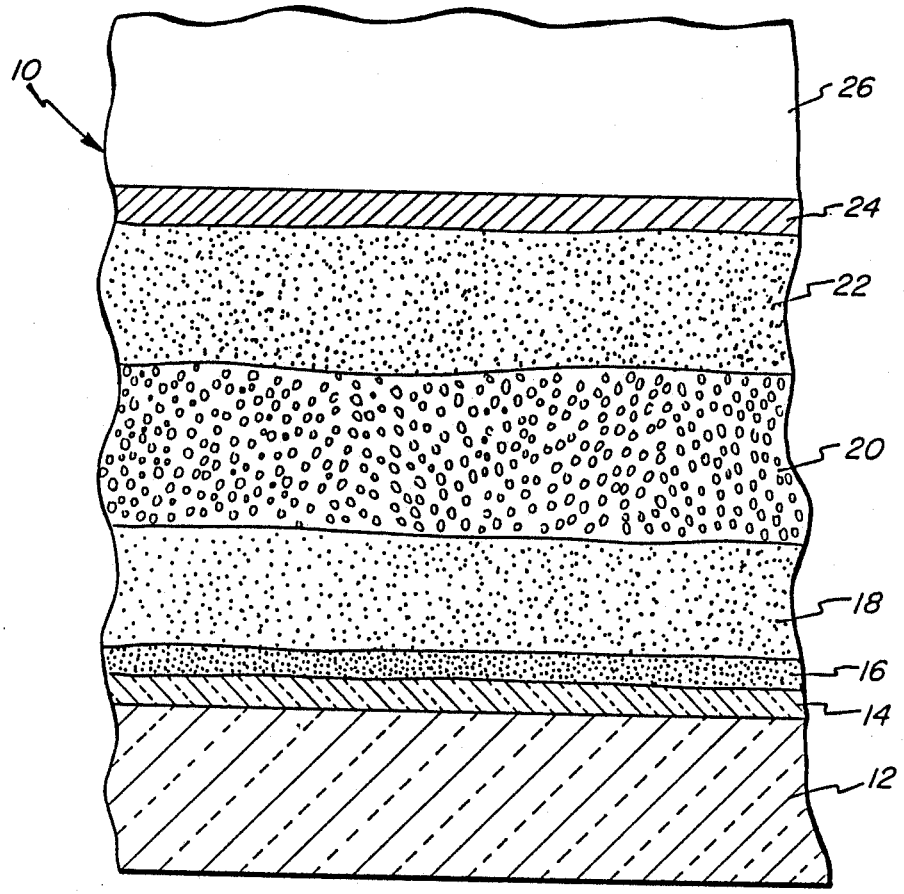

Referring now to the single drawing FIGURE, depicted in cross section is a typical electroluminescent device 10. The figure may be viewed either as the cross section of an electroluminescent lamp having continuous electrodes, or as the cross section of a single pixel in a electroluminescent display having defined row and column electrodes which overlap to define pixel locations.

The device 10 is formed on a suitable transparent substrate 12 such as a glass known as Corning 7059. Light from the device 10 is transmitted through the glass substrate 12.

Deposited directly on the substrate 12 is a "front" electrode 14 comprising indium tin oxide (ITO). In the case of an electroluminescent display, the "front" electrode 14 may arbitrarily be designated the "column" electrode.

In order to achieve a relatively high resistivity, for example in the range of from 4,000 to 6,000 ohms per square, the ITO layer 14 should be less than 100 angstroms ($100\times10^{-10}$ meters) in thickness.

In accordance with the invention, this ultra-thin ITO layer 14 is stabilized or "passivated" by a layer 16 of metal oxide, which has a thickness, before oxidation, of less than 100 angstroms and, preferably, within the range of 30 to 50 angstroms. Preferably, the layer 16 comprises palladium oxide, but other metal oxides may be employed as well, such as nickel oxide.

The resulting double layer of ITO 14 and metal oxide 16 is highly stable, and does not change or burn out while carrying the currents associated with bright electroluminescent device operation.

The next device layer is a dielectric layer 18, typically 3 or 4 thousands angstroms in thickness. A variety of materials are known for the dielectric layer 18 such as $Y_2O_3$, $Al_2O_3$, $SiO_2$, $Si_3N_4$, and amorphous $BaTiO_3$. However, the presently-preferred dielectric is a tantalum suboxide of the form $Ta_2O_mX_{5-m}$, where $4.5<m<5.0$, and X is a suitable anion for stabilizing the oxide structure, such as an OH radical. This particular dielectric, and methods for making it, are described in the above-identified companion application Ser. No. 813,928.

The next layer is an electroluminescent layer 20, which also may be termed a phosphor. The electroluminescent layer 20 is typically 5000 angstroms in thickness, and typically is ZnS as a host with Mn as an activator, as is well known in the art.

The next layer 22 is another dielectric layer, which is substantially the same as or thinner than the dielectric layer 18.

A "rear" electrode 24 is provided, which may comprise an aluminum layer several thousand angstroms in thickness. Normally, the aluminum "rear" electrode 24 is reflective, thereby nearly doubling the light output from the device as viewed through the glass substrate 12.

Finally, a suitable seal material 26 encapsulates the entire structure, inasmuch as any moisture allowed to enter the structure would accelerate failure.

It will be appreciated that appropriate edge connection leads (not shown) are required to enable an AC electric field to be applied to the electrodes 14 and 24.

Steps of a method for forming the device 10, of the drawing, particularly the electrode structure comprising the optically transmissive electrode 14 and its metal oxide coating 16, will now be described.

(1) As an initial step, the optically transmissive substrate 12 having an optically transmissive electrically conductive layer 14 of indium tin oxide formed thereon is provided. Various glasses are employed for the substrate 12, a typical one being known as Corning 7059. Processes for forming the electrically conductive ITO layer are well known, and begin with the deposition of indium tin oxide employing any suitable technique such as electron beam evaporation, chemical vapor deposition, or sputtering. The ITO layer as initially deposited is not a good electrical conductor, but the layer is rendered electrically conductive by heating to 500° C., and is thereafter cooled.

(2) Next, the indium tin oxide layer is coated with a metal layer less than 100 angstroms in thickness, and preferably within the range of from 30 to 50 angstroms in thickness. Preferably, the coating is palladium metal, but other metals may be employed, such as nickel. Again, any suitable deposition technique may be employed, such as electron beam evaporation, chemical vapor deposition, or sputtering. Deposition of a metal prior to oxidation facilitates control of the ultimate oxide.

(3) Next, the metal layer is oxidized. This can be accomplished by heating in an atmosphere including oxygen, such as heating in air, to a temperature of approximately 500° C. In accordance with the invention, the optically-transmissive ITO layer is thus stabilized, and the resulting double layer of ITO 14 and metal oxide 16 is highly stable and does not change or burn out while carrying large currents involved in electroluminescent device operation.

(4) The remaining layers are formed employing conventional techniques including vapor deposition, sputtering, atomic layer epitaxy, and chemical vapor deposition. Again, as noted above, preferably the dielectric layers 18 and 22 are formed as described in the above-identified companion application Ser. No. 813,928.

While the invention has been described above primarily in the context of an electroluminescent device, it will be appreciated that optically transmissive electrical conductors are required in a variety of other applications, and the "passivated" ITO of the present invention is applicable to these as well.

While specific embodiments of the invention have been illustrated and described herein, it is realized that numerous modifications and the changes will occur to those skilled in the art. It is therefore to be understood that the appended claims are intended to cover all such modifications and the changes as both in the true spirit and scope of the invention.

What is claimed is:

1. An electroluminescent device, comprising:

an electroluminescent layer sandwiched between a pair of electrodes and separated from said electrodes by respective dielectric layers;

at least one of said electrodes being optically transmissive and comprising a layer of indium tin oxide on an optically transmissive substrate; and a stabilizing layer comprising a metal oxide selected from a group consisting of palladium oxide and nickel oxide over said layer of indium tin oxide.

2. A device in accordance with claim 1, wherein said stabilizing layer is formed of an oxidized layer of a metal having a thickness less than 100 angstroms prior to oxidation.

3. A device is accordance with claim 2, wherein the thickness of the metal layer prior to oxidation is within the range of from 30 to 50 angstroms.

4. A device in accordance with claim 1, wherein said layer of indium tin oxide has a thickness of less than 100 angstroms.

5. A device in accordance with claim 1, wherein said optically transmissive substrate comprises glass.

6. An optically transmissive conductor, comprising:

a layer of indium tin oxide on a substrate; and a stabilizing layer of metal oxide selected from a group consisting of palldium oxide and nickel oxide over said layer of indium tin oxide.

7. A conductor structure in accordance with claim 6, wherein said stabilizing layer is formed of an oxidized layer of a metal having a thickness less than 100 angstroms prior to oxidation.

8. A conductor structure in accordance with claim 7, wherein the thickness of the metal prior to oxidation is within the range of from 30 to 50 angstroms.

9. A conductor structure in accordance with claim 6, wherein said layer of indium tin oxide has a thickness of less than 100 angstroms.

* * * * *